United States Patent [19]

Allen

[11] Patent Number: 4,800,783

[45] Date of Patent: Jan. 31, 1989

[54] METHOD AND APPARATUS FOR REMOVING A CORK OR PLASTIC STOPPER FROM A CHAMPAGNE BOTTLE

[76] Inventor: Herbert Allen, 3207 Groveland, Houston, Tex. 77019

[21] Appl. No.: 58,566

[22] Filed: Jun. 5, 1987

[51] Int. Cl.[4] ..... B67B 7/02

[52] U.S. Cl. ..... 81/3.4

[58] Field of Search ..... 81/3.4, 3.07, 3.44

[56] References Cited

U.S. PATENT DOCUMENTS

| | | | |
|---|---|---|---|
| 2,495,308 | 1/1950 | Amigone | 81/3.44 |
| 2,761,338 | 12/1953 | Hardy . | |
| 3,628,405 | 12/1971 | Fleisher . | |
| 4,296,653 | 10/1981 | Lundgren et al. . | |
| 4,387,609 | 6/1983 | Polsfuss . | |
| 4,433,360 | 3/1984 | Becker . | |
| 4,442,735 | 4/1984 | Chance et al. . | |
| 4,474,087 | 10/1984 | Widman . | |
| 4,519,277 | 4/1985 | Raab . | |
| 4,602,245 | 8/1986 | Veverka et al. . | |

FOREIGN PATENT DOCUMENTS

| | | | |
|---|---|---|---|
| 1519035 | 2/1968 | France . | |
| 149173 | 3/1955 | Sweden | 81/3.4 |
| 10192 | of 1889 | United Kingdom | 81/3.44 |
| 27632 | of 1910 | United Kingdom | 81/3.44 |
| 83/02265 | 7/1983 | World Int. Prop. O. | 81/3.4 |

OTHER PUBLICATIONS

Advertisement for the Champagne Key, undated, one page.

*Wine Ambiance,* catalog by America's Wineland Crafts, 1986 Edition, p. 8.

*The Wine Enthusiast,* catalog, 1986 Edition, pp. 2 and 14.

Advertisement for the Uncorker, dated 10/83, one page.

*Primary Examiner*—Roscoe V. Parker

*Attorney, Agent, or Firm*—Browning, Bushman, Zamecki & Anderson

[57] ABSTRACT

Apparatus and method for removing a stopper from a bottle having an internal pressure greater than the ambient pressure surrounding the bottle, e.g. a champagne bottle. At least one generally vertical edge of the apparatus is placed in a generally vertical groove in the periphery of the stopper, in some cases cutting the groove simultaneously as it is moved downward over the stopper. The apparatus is then oscillated or rotated, whereupon the internal pressure in the bottle can overcome the sliding friction between the stopper and the bottle. The apparatus is also adapted to control the stopper, once expelled.

24 Claims, 3 Drawing Sheets

METHOD AND APPARATUS FOR REMOVING A CORK OR PLASTIC STOPPER FROM A CHAMPAGNE BOTTLE

BACKGROUND OF THE INVENTION

1. Field of the Invention

The invention relates, generally, to apparatus for removing a bottle stopper, and specifically to apparatus for controlling the removal of a stopper used in bottling champagne or sparkling wines having internal pressures greater than ambient.

2. Description of the Background

The difficulty of removing a cork from a champagne bottle, as well as the difficulty of controlling the cork once it exits from the bottle, are both well known. It has been reported throughout the years, perhaps centuries, that emancipated champagne corks have flown through the air with such force as to cause an untold number of eye injuries to unsuspecting wine stewards.

The task of removing the cork or stopper, however, has baffled those skilled in this art. The prior art is typified by various schemes which call for a vertical lifting force to be applied to the cork, for example, such as is disclosed in U.S. Pat. No. 2,761,338 to Charles H. A. Hardy; U.S. Pat. No. 4,387,609 to Marvin F. Polsfuss; U.S. Pat. No. 4,519,277 to Clifford G. Raab; U.S. Pat. No. 4,437,360: and U.S. Pat. No. 4,442,735 to Allen Chance et al. Again, each of these prior art devices has concentrated upon the concept of applying a pulling force to the cork or stopper to remove it from the bottle. Pulling a cork in this manner can require a great deal of force.

SUMMARY OF THE INVENTION

In accord with the present invention, it is unnecessary to apply any external lifting force to the cork. The invention uses the pressure in a champagne bottle. Moreover, the static friction between the sides of the cork and the interior neck of the bottle is much greater than the sliding friction between those same surfaces. By applying a rotary motion to the cork, with no external lifting force, the internal pressure of the bottle overcomes the sliding friction between the cork and the bottle surfaces, and the cork comes right out. The rotary action needed to establish sliding friction is quite easy to apply, compared to a pulling action. In addition, the inventor has discovered that he can make use of the fact that champagne bottles have wire grooves or indentations in the top of the stopper.

The invention therefore comprises an apparatus and method which uses one or more edges to engage the grooves in the top of a stopper, and that by then rotating the apparatus with respect to the bottle, the internal pressure of the bottle will overcome the sliding friction of the rotating stopper and the stopper is thus extracted.

The apparatus and method according to the invention also use the edges and/or the center of the apparatus to control the stopper once extracted.

When using the method and apparatus of the present invention with a cork stopper, the edges of the apparatus, if sufficiently sharp knife edges, can make their own indentations or grooves prior to imparting the rotary motion to the cork.

Further features, objects and advantages of the present invention will be better understood from the following detailed description when taken in conjunction with the accompanying drawings.

DETAILED DESCRIPTION OF THE PREFERRED EMBODIMENT

Figure 1:
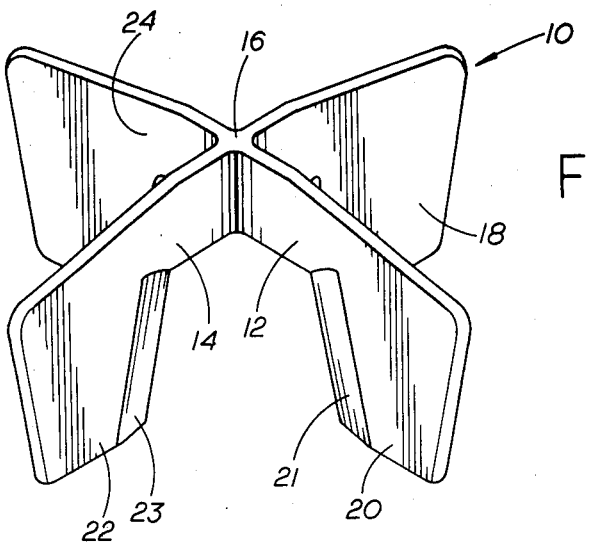
FIG. 1 is an isomeric, pictorial view of a first embodiment of the present invention having four orthogonally spaced knife edges.
Figure 2:
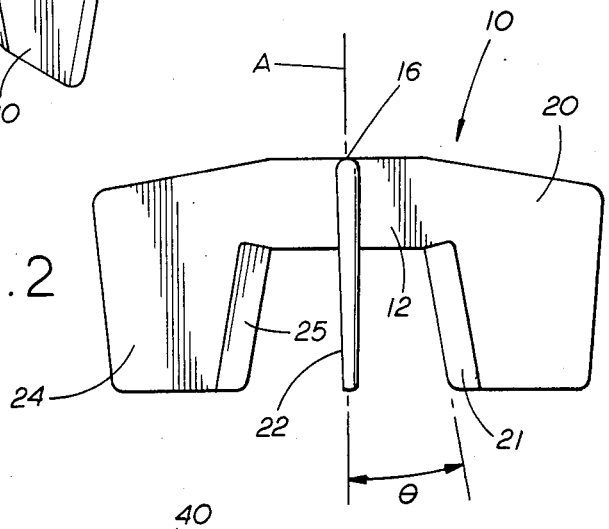
FIG. 2 is a side elevational view of the apparatus illustrated in FIG. 1.

Referring now to FIGS. 1 and 2, there is illustrated an apparatus 10, preferably formed as a single piece, metal body. Although shown as a single body, the apparatus 10 can be considered as a pair of inverted U-shaped members 12 and 14 secured at their midpoint 16, so that their four legs 18, 20, 22 and 24 are disposed at 90° from each adjacent leg. Each of the legs 18, 20, 22 and 24 has a knife edge 19 (not illustrated), 21, 23 and 25 (not illustrated), respectively, with each of the knife edges angled generally upwardly and inwardly toward the axis A through center point 16.

As used herein, words such as "upwardly" and "downwardly" will refer to the position of the apparatus in ordinary use upon an upright bottle, and as shown in the drawings, and should not be construed in a limiting sense. When an edge, surface or other member is said herein to be "generally vertical," as are the edges 19, 21, 23 and 25, this will mean that, if broken down into horizontal and vertical vector components of direction, there is a substantial vertical component.

The knife edge 21 in FIG. 2 is angled upwardly and inwardly through the angle $\theta$ toward the intended rotational axis A of the apparatus 10, coinciding with the longitudinal axis of the cork or plastic stopper and also with the longitudinal axis of the bottle. Although the angle $\theta$ in the preferred embodiment may vary a few degrees, the preferred angle $\theta$ is approximately 15 to 20 degrees. It has been found that an angle $\theta$ of approximately 15 to 20 degrees will allow the apparatus to firmly and properly engage a wide variety of champagne stoppers, indeed virtually all types of champagne stoppers currently known to the present inventor. If the edges are sharp knife edges capable of cutting their own grooves, relatively wide angles can be employed. If the edges are longer axially, much smaller angles can be used.

Figure 7:
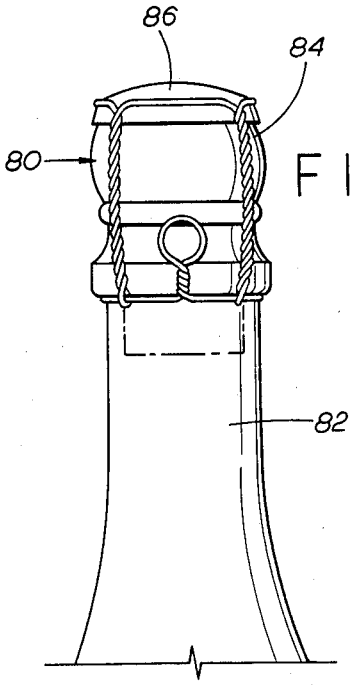
FIG. 7 is a pictorial view of a cork stopper in place in a champagne bottle.
Figure 9:
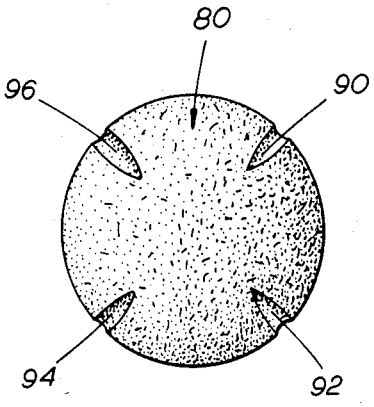
FIG. 9 is a top pictorial view of a cork stopper having four orthogonally spaced grooves.
Figure 10:
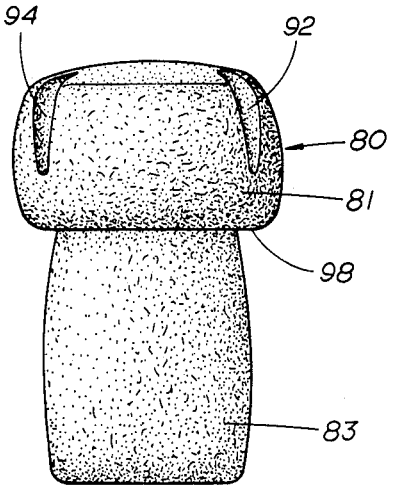
FIG. 10 is a side elevational, pictorial view of a cork stopper removed from a champagne bottle.

FIGS. 7, 9 and 10 illustrate a cork stopper 80, first in place in a champagne bottle 82 as secured by a wire 84. While in place, the cork stopper typically has a metal foil cap 86 which acts to prevent the wire 84 from cutting too deeply into the cork. As can best be seen in FIGS. 9 and 10, after the wire 84 is removed, there are four orthogonally spaced, generally vertical grooves 90, 92, 94 and 96 in the upper peripheral surface of the cork stopper 80 caused by the wire 84.

In the operation of the apparatus illustrated in FIG. 1, the wire 84 is first cut and removed from the top of stopper 80 in the conventional way. The apparatus 10 is then placed downwardly over the top of the stopper 80, such that the knife edges 19, 21, 23 and 25 enter the grooves 90, 92, 94 and 96 in the stopper 80 with a sort of sliding action. Alternatively, the knife edges can cut their own grooves in the top side of the cork stopper, or they can cut deeper into the existing grooves. The apparatus 10 is then rotated, or can be oscillated back and forth a few degrees about the longitudinal axis of the bottle 82 and stopper 80, thus allowing the internal pressure of the bottle 84 to overcome the sliding friction between the stopper and the bottle, thus causing the stopper to be expelled. It should be appreciated that the converging knife edges 19, 21, 23 and 25 and the center 16 of the apparatus 10 will safely control the exit of the stopper 80.

Figure 8:
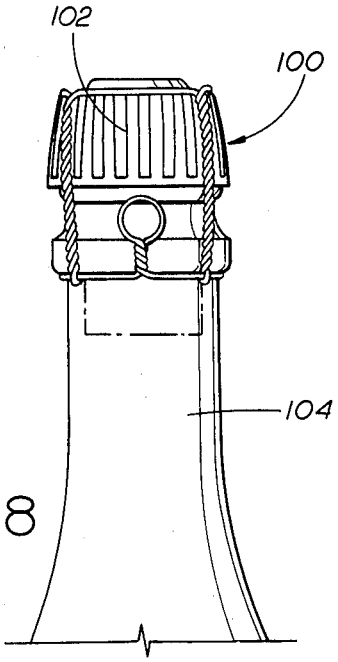
FIG. 8 is a pictorial view of a plastic stopper in place in a champagne bottle.
Figure 11:
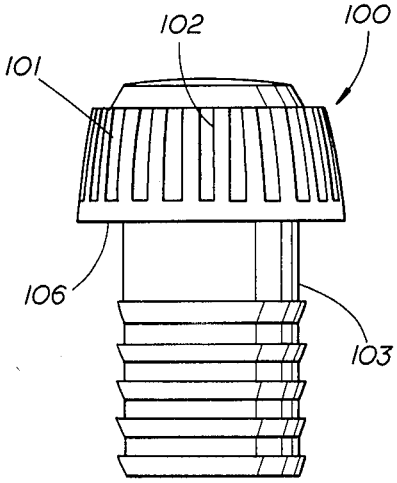
FIG. 11 is a side elevational, pictorial view of a plastic stopper used with champagne bottles.

It should also be appreciated that when the apparatus 10 is used to extract a plastic stopper 100 as illustrated in FIGS. 8 and 11, the knife edges 19, 21, 23 and 25 can be easily inserted into the generally vertical serrations 102 in the plastic stopper. After the knife edges are in the serrations 102, the operation of the apparatus 10 is identical to that described above with respect to the removal of a cork stopper.

Figure 3:
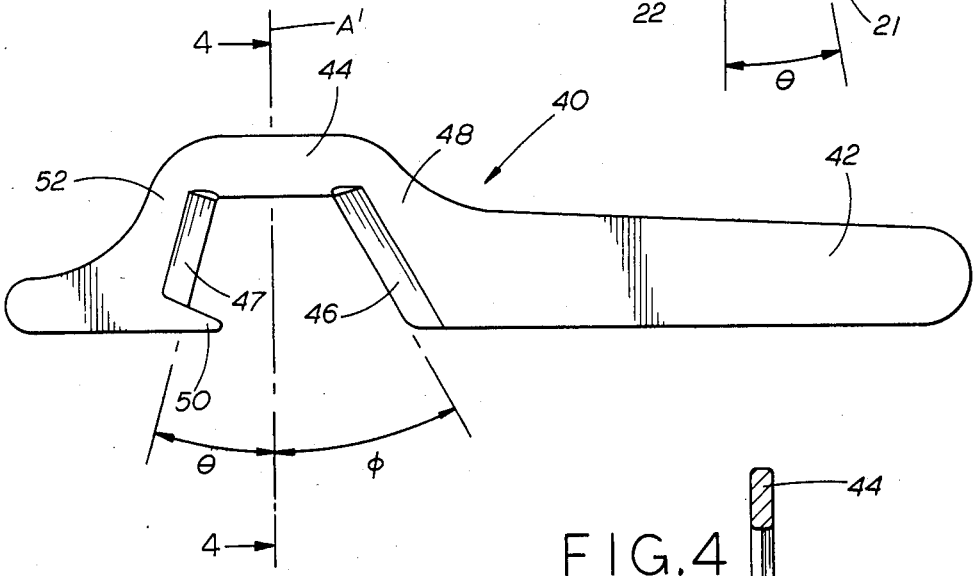
FIG. 3 is a side elevational view of a second embodiment of the present invention having a hook and a single knife edge.
Figure 4:
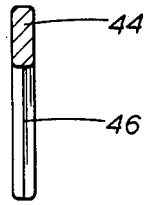
FIG. 4 is a cross-sectional view taken along the lines 4—4 of FIG. 3.

FIG. 3 illustrates a second embodiment of the present invention. The apparatus 40 comprises a handle 42 attached to leg 48 of an inverted U-shaped member 44 having a generally vertical knife edge 46 on the leg 48 of the inverted U-shaped member 44, and a generally vertical knife edge 47 on the other leg 52. On the leg 52, at the free, i.e. the end distal the base of the U-shape, there is also a laterally inwardly extending hook-like projection 50. The knife edge 47 is angled upwardly and inwardly through the angle $\theta$ toward the intended rotational axis A', coincident with the centerline of the U-shape. As with the embodiment illustrated in FIG. 2, the preferred angle $\theta$ is approximately 15 degrees, but may vary. The knife edge 46 is angled upwardly and inwardly through the angle $\phi$ towards the axis A'. The preferred angle $\phi$ is approximately 30 degrees, but may also vary. The reason angle $\phi$ is greater than angle $\theta$ is to allow the knife edge 46 to roll over the top of the stopper after first placing the hook 50 under the lower lip 98 of the stopper. As in the case of the apparatus 10 of FIG. 1, the apparatus 40 is preferably made as a single unit, metal body.

In the operation of the apparatus 40, handle 42 is angled upward and hook-like projection 50 is placed under the lip 98 of the stopper 80 illustrated in FIG. 10. As the handle 42 is moved downward to a lateral position, with hook 50 providing a pivot point, the knife edge 46 then rolls over the top of the stopper and enters one of the grooves 90, 92, 94 or 96, or can make its own groove if a cork stopper is to be removed. Meanwhile, edge 47 enters an opposite groove or makes one of its own. The handle 42 is then rotated, or oscillated back and forth to expel the cork stopper. When used with the plastic stopper 100 of FIG. 11, the hook 50 is first placed under the lower lip 106 and then the knife edge 46 rolls over the top of the stopper and is placed in one of the serrations 102, followed by the rotation or oscillation of the apparatus 40. It should be appreciated that the angled knife edges 46 and 47 and the shape of U-shaped member 44 will safely control the expulsion of the stopper, whether plastic or cork.

Figure 5:
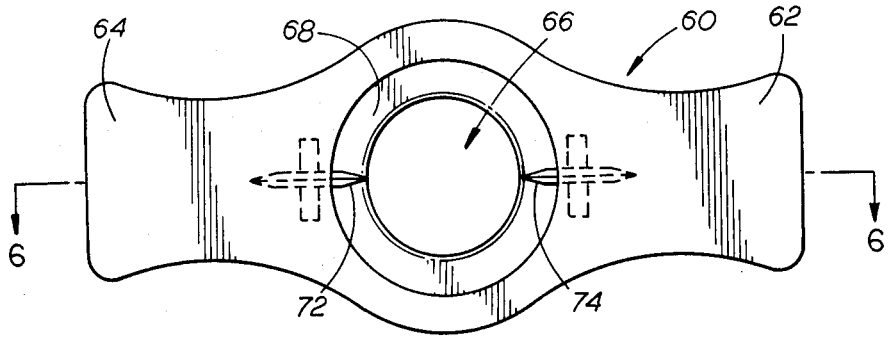
FIG. 5 is a lower plan view of a third embodiment of the present invention having a pair of roller knife edges.
Figure 6:
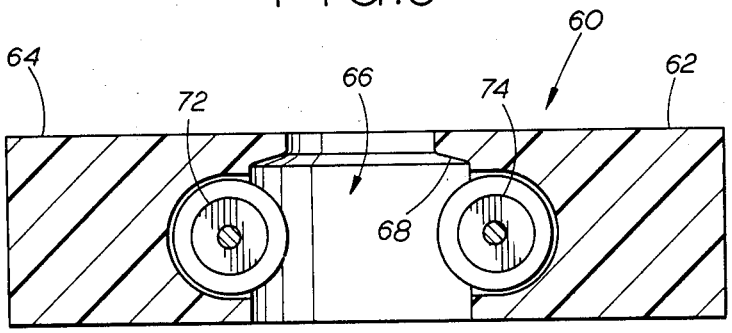
FIG. 6 is a cross-sectional view taken along the lines 6—6 of FIG. 5.

FIGS. 5 and 6 illustrate a third embodiment of the present invention. The apparatus 60 comprises a molded plastic body having integral handles 62 and 64 extending laterally outwardly from the body of apparatus 60. A central throughbore 66 is sized to allow the entrance of stoppers 80 or 100. The annular upper flange 68 surrounding throughbore 66 has an internal diameter smaller than the diameter of the stopper, thus providing a control of the stopper once it is expelled from the bottle. On opposite sides of the throughbore 66, a pair of knife-edge rollers 72 and 74 are rotatably mounted so that their edges project into the throughbore and lie generally vertical with respect to the longitudinal axis of the throughbore, and hence the longitudinal axis of the bottle.

In the operation of the apparatus 60, as the device is lowered over the stopper in the champagne bottle, the edges of the rollers 72 and 74 engage a pair of the grooves or serrations in the cork or plastic stopper. The rollers 72 and 74 are preferably made of metal and can be designed, depending upon the degree of sharpness, to merely roll into the grooves or to cut their own grooves, or to dig deeper into the existing grooves, in the case of a cork stopper. Once the rollers 72 and 74 are in a pair of grooves or serrations, the operation is identical to that described above with respect to FIGS. 1 and 3.

Thus, there has been described herein three embodiments of the present invention which can be used to safely remove a champagne stopper without using any external pulling force. Although the specification refers generally to the removal of a stopper from a champagne bottle, the invention can be used in removing a stopper from any bottle having a sufficient internal pressure to overcome the sliding friction between the stopper and the interior neck of the bottle. Moreover, because of the angled nature of the knife edges used in the various embodiments, the invention works equally well with almost any size of stopper used in this industry.

Obvious variations of the preferred embodiment will become apparent from a reading of the foregoing specification. Although "knife edges" are used in the preferred embodiments, those skilled in the art will immediately recognize that the degree of sharpness can vary considerably, from razor sharp to well rounded, depending upon the extent to which a cutting action is desired. Thus, the invention contemplates the use of means to enter and utilize the preformed grooves or serrations to rotate the stopper, without regard for the sharpness of the edges or members being used. Moreover, although the second preferred embodiment contemplates the use of a hook, those skilled in the art will recognize that other types of abutments can be used on one side of the stopper opposed from a single knife edge to enable rotation of the stopper.

The first embodiment of FIGS. 1 and 2 has been described as a pair of inverted U-shaped plate-like members orthogonally joined together. An acceptable device can be made utilizing a single such inverted U-shaped member. Still other modifications will suggest themselves to those of skill in the art. Accordingly, it is intended that the scope of the invention be limited only by the following claims.

What is claimed is:

1. A method for removing a stopper from a bottle having an internal pressure within said bottle higher than the ambient pressure surrounding said bottle, wherein said stopper has at least one preformed, generally vertical groove in its upper peripheral surface, comprising:

placing means into at least one of said grooves; and using said means to rotate said stopper with respect to said bottle, thereby reducing static friction between the bottle and stopper to sliding friction and allowing said internal pressure to expel the stopper from the bottle.

2. The method according to claim 1 wherein said means comprises at least one knife edge.

3. The method according to claim 2 comprising radially engaging said stopper generally opposite said one knife edge by means connected to said one knife edge to retain said one knife edge in said groove.

4. The method according to claim 3 wherein said stopper has a plurality of such grooves, and said means connected to said one knife edge comprises a second knife edge placed in a second of said grooves.

5. The method according to claim 4 wherein said stopper is comprised of cork, and said grooves are formed by wire used to secure said stopper in said bottle.

6. The method according to claim 4 wherein said stopper is comprised of plastic, and said grooves are defined by serrations.

7. The method according to claim 2 wherein said knife edge is so placed in said groove by a generally axial movement with respect to said bottle.

8. A method for removing a cork stopper having an upper radial surface from a bottle having an internal pressure within said bottle higher than the ambient pressure surrounding said bottle, comprising:

using at least one knife edge to cut a generally vertical groove into the upper peripheral surface of said cork stopper; and retaining said at least one knife edge in said groove and using said one knife edge to rotate said cork stopper with respect to said bottle, thereby reducing static friction between the bottle and stopper to sliding friction and allowing said internal pressure to expel the stopper from the bottle.

9. The method according to claim 8 comprising laterally engaging said stopper generally opposite said one knife edge by means connected to said one knife edge to retain said one knife edge in said groove.

10. The method according to claim 9 wherein said stopper has a plurality of such grooves, and said means connected to said one knife edge comprises a second knife edge placed in a second of said grooves.

11. The method according to claim 8 wherein said knife edge is so placed in said groove by a generally axial movement with respect to said bottle.

12. An apparatus for removing a stopper from a bottle having an internal pressure greater than the ambient pressure surrounding said bottle, comprising a U-shaped member having a handle and having opposed first and second interior surfaces in its U-shape, said first surface having a hook for fitting under a lip of said stopper and also defining a first edge for engaging said first groove and said second surface defining a second edge for engaging said second groove, thereby allowing the stopper to be rotated, thus allowing the internal pressure of said bottle to expel the stopper from the bottle.

13. The apparatus according to claim 12 wherein said handle extends laterally outwardly from that leg of the U-shape which includes said second edge.

14. The apparatus according to claim 12 wherein said edges are angled inwardly toward the base of said U-shape.

15. The apparatus according to claim 14 having an intended axis of rotation generally coincident with the centerline of the bottle in use, said second edge being disposed at a wider angle to said axis than said first edge.

16. The apparatus according to claim 14 wherein said first edge is disposed at an angle of about 15° to said axis and said second edge is disposed at an angle of about 30° to said axis.

17. The apparatus according to claim 16 wherein said edges are knife edges.

18. An apparatus for removing a stopper from a bottle having an internal pressure greater than the ambient pressure surrounding said bottle, comprising generally vertical knife edge means to enter and engage groove means in said stopper, thereby enabling the rotation of said stopper with respect to said bottle and the expulsion of said stopper from said bottle.

19. The apparatus according to claim 18 wherein said knife edge means comprise a plurality of circumferentially spaced knife edges.

20. An apparatus for removing a stopper from a bottle having an internal pressure greater than the ambient pressure surrounding said bottle, comprising a body having a central throughbore for receiving said cork stopper and means in said throughbore for engaging grooves in said cork, thereby enabling said cork to be rotated with respect to said bottle and the expulsion of said cork from said bottle.

21. The apparatus according to claim 20, wherein said means comprises a pair of generally vertical thin-edged rollers.

22. The apparatus according to claim 21 including, in addition thereto, a flange around the top side of said throughbore for controlling the expulsion of said cork from said bottle.

23. The apparatus according to claim 22 further comprising laterally outwardly extending handle means.

24. The apparatus according to claim 22 wherein said rollers have knife edges.

* * * * *